US008971765B2

(12) United States Patent
Inagaki et al.

(10) Patent No.: US 8,971,765 B2
(45) Date of Patent: Mar. 3, 2015

(54) INTERMEDIATE TRANSFER MEMBER AND METHOD FOR MANUFACTURING THE SAME, INTERMEDIATE TRANSFER MEMBER UNIT, AND IMAGE FORMING APPARATUS

(75) Inventors: Tomotake Inagaki, Kanagawa (JP); Shigeru Fukuda, Kanagawa (JP); Masashi Hamabe, Kanagawa (JP); Tomoo Matsushima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 259 days.

(21) Appl. No.: 13/220,177

(22) Filed: Aug. 29, 2011

(65) Prior Publication Data

US 2012/0243907 A1 Sep. 27, 2012

(30) Foreign Application Priority Data

Mar. 24, 2011 (JP) ..... 2011-066472

(51) Int. Cl.
*G03G 15/16* (2006.01)

(52) U.S. Cl.
CPC ..... *G03G 15/162* (2013.01)
USPC ..... 399/162; 399/302

(58) Field of Classification Search
CPC ..... G03G 15/162
USPC ..... 399/308
See application file for complete search history.

(56) References Cited

U.S. PATENT DOCUMENTS

| | | | | |
|---|---|---|---|---|
| 5,409,758 | A * | 4/1995 | Hiyoshi et al. | 428/32.62 |
| 5,519,475 | A * | 5/1996 | Miyamoto et al. | 399/308 |
| 7,046,952 | B2 * | 5/2006 | Kurotori et al. | 399/340 |
| 7,524,596 | B2 * | 4/2009 | Bender et al. | 430/56 |
| 7,534,534 | B2 * | 5/2009 | Nakata et al. | 430/56 |
| 7,747,207 | B2 * | 6/2010 | Tanaka et al. | 399/340 |
| 2007/0160790 | A1 * | 7/2007 | Kaneko et al. | 428/35.7 |
| 2010/0080625 | A1 * | 4/2010 | Furuya et al. | 399/121 |

FOREIGN PATENT DOCUMENTS

| | | | | |
|---|---|---|---|---|
| EP | 431930 | A2 * | 6/1991 | G03G 9/097 |
| JP | A-02-231129 | | 9/1990 | |
| JP | A-03-131883 | | 6/1991 | |
| JP | A-05-094096 | | 4/1993 | |
| JP | A-07-110615 | | 4/1995 | |

* cited by examiner

*Primary Examiner* — Ryan Walsh
*Assistant Examiner* — Philip Marcus T Fadul
(74) *Attorney, Agent, or Firm* — Oliff PLC

(57) ABSTRACT

Disclosed is an intermediate transfer member including, a resin layer as an outermost layer, in which plural recessed portions having a curved inner wall are scattered on the surface thereof.

18 Claims, 7 Drawing Sheets

INTERMEDIATE TRANSFER MEMBER AND METHOD FOR MANUFACTURING THE SAME, INTERMEDIATE TRANSFER MEMBER UNIT, AND IMAGE FORMING APPARATUS

CROSS-REFERENCE TO RELATED APPLICATIONS

This application is based on and claims priority under 35 USC 119 from Japanese Patent Application No. 2011-066472 filed on Mar. 24, 2011.

BACKGROUND

Technical Field

The present invention relates to an intermediate transfer member, a method for manufacturing the same, an intermediate transfer member unit, and an image forming apparatus.

SUMMARY

According to an aspect of the invention, there is provided an intermediate transfer member including, as an outermost layer, a resin layer in which plural recessed portions having a curved inner wall are scattered on the surface thereof.

BRIEF DESCRIPTION OF THE DRAWINGS

Exemplary embodiments of the present invention will be described in detail based on the following figures, wherein.

DETAILED DESCRIPTION

Hereinafter, exemplary embodiments will be described in detail with reference to drawings.

(Intermediate Transfer Member)

Figure 1:
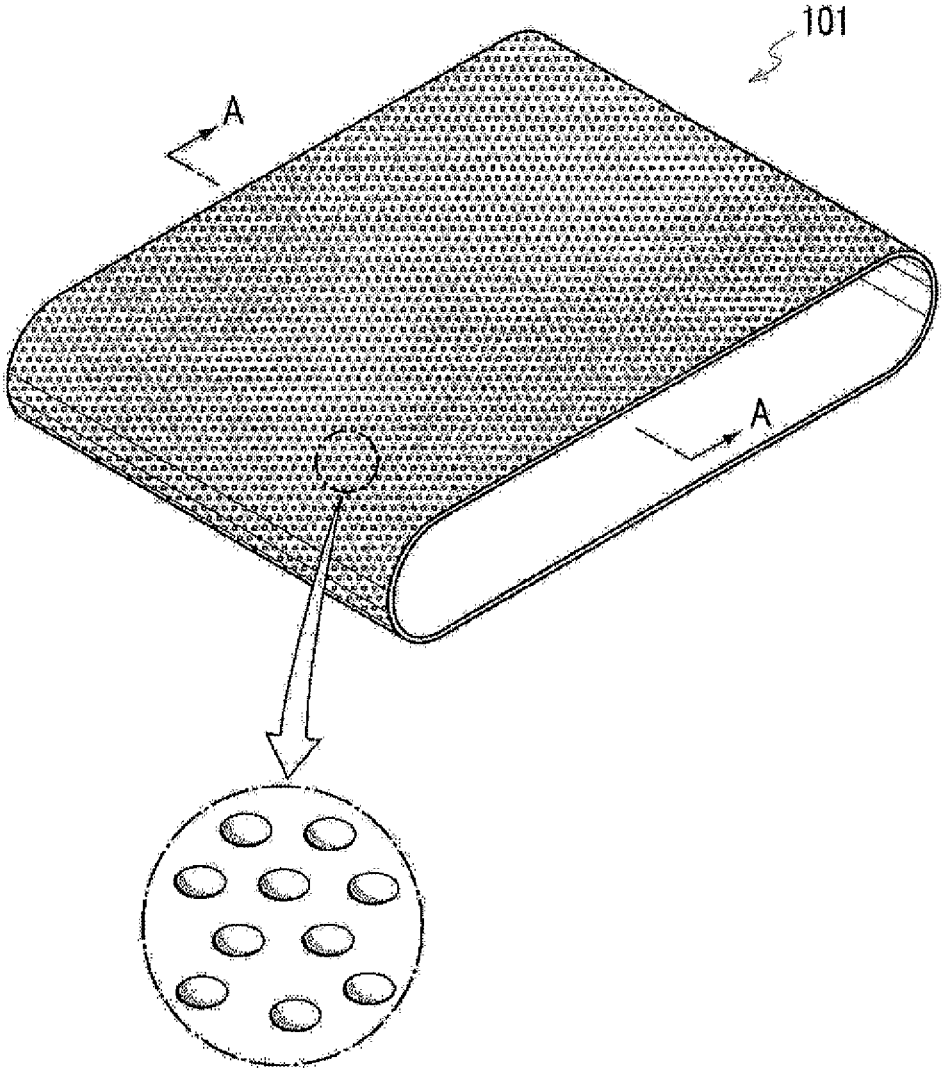
FIG. 1 is a schematic perspective view illustrating an intermediate transfer member according to an exemplary embodiment.
Figure 2:
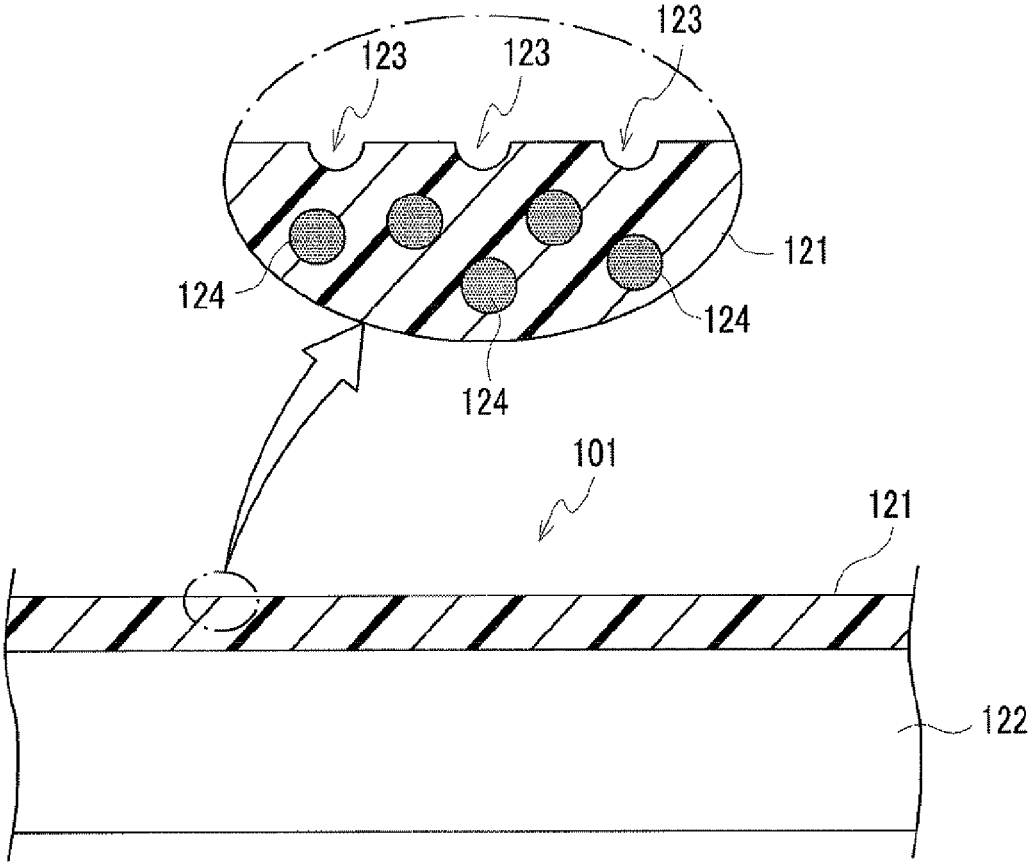
FIG. 2 is a sectional view taken along the line of A-A of FIG. 1.

FIG. 1 is a schematic perspective view illustrating an intermediate transfer member according to an exemplary embodiment. FIG. 2 is a sectional view taken along the line A-A of FIG. 1.

The intermediate transfer member 101 according to the exemplary embodiment is for example a belt member, which is provided in an endless form and is a layered structure including a base layer 122 having a thickness for example of from 30 μm to 80 μm and an outermost layer 121 having a thickness for example of from 5 μm to 70 μm arranged on the outer peripheral surface of the base layer 122, as shown in FIGS. 1 and 2.

In addition, the outermost layer 121 is a resin layer in which plural recessed portions 123 having a curved inner wall are scattered on the surface thereof (the outermost surface of the intermediate transfer member).

Here, in the related art, fluorine resin particles are incorporated in the outermost layer of the intermediate transfer member and the fluorine resin particles are exposed to the outermost layer, to realize releasability and thus transferability.

However, for example, reduction in diameter of toner (for example, toner having small toner particles with a volume average particle diameter of from 2.0 μm to 6.5 μm) causes a decrease in charge amount per toner particle (one toner particle) and thus reduction of electrostatic adherence to an image-supporting material, but increases non-electrostatic adhesive forces such as Van der Waals attraction (intermolecular force) to intermediate transfer members. Transference of toner having a small particle diameter by a transfer electric field is more difficult, as compared to toner having a large particle diameter. Accordingly, there is a novel demand for improvement of transferability.

Accordingly, the intermediate transfer member 101 according to the exemplary embodiment includes, as an outermost layer 121, a resin layer in which plural recessed portions 123 having a curved inner wall are scattered on the surface thereof (outermost surface of the intermediate transfer member 101) and thus exhibits improved transferability.

The reason is not clear, but it is thought that when the recessed portions 123 having a curved inner wall are scattered on the surface of the outermost layer 121 which contacts the toner (toner particles), an area where the toner (toner particles) contacts the outermost layer 121 reduces, external additive particles are readily adhered to the inner wall of the recessed portions 123, rather than the surface of the outermost layer 121, and the external additive particles adhered to the inner wall of the recessed portions 123 result in a reduced adhesive force of toner (toner particles) to the outermost layer 121.

In addition, the intermediate transfer member 101 according to the exemplary embodiment exhibits improved transferability, in particular, although a small diameter toner (for example, toner having small toner particles having a volume average particle diameter of from 2.0 μm to 6.5 μm) which readily exhibits deteriorated transferability is used.

In addition, in the intermediate transfer member 101 according to the exemplary embodiment, the recessed portion 123 provided on the surface of the outermost layer 121 is indented from the flat surface thereof and a convex portion is not provided on the surface of the outermost layer 121. Accordingly, cleaning defects caused by the convex portion on the surface of the outermost layer 121 (for example, cleaning defects caused by abrasion and defects of a cleaning blade) are suppressed.

In particular, an intermediate transfer member having the outermost layer containing fluorine resin particles (the outermost layer in which the fluorine resin particles are exposed to the surface thereof) has a surface on which fluorine resin particles with superior releasability are convexly protruded and exposed, and initial cleaning defects thus may readily occur. However, the intermediate transfer member 101 according to the exemplary embodiment easily suppresses this problem.

In addition, in order to reduce an area where the toner (toner particles) contacts the outermost layer and thus improve transfer efficiency, the surface of the outermost layer 121 may be roughened. However, when the surface of the outermost layer 121 is roughened, a convex portion is formed on the outermost layer 121 and the convex portion may readily cause cleaning defects.

In addition, in the intermediate transfer member 101 according to the exemplary embodiment, particulate materials such as fluorine resin particles are not present on the surface of the outermost layer 121, unevenness of a transfer electric field caused by presence of the particulate materials is thus suppressed and graininess of obtained images is also improved.

Hereinafter, constituent materials and characteristics of the intermediate transfer member 101 according to the exemplary embodiment will be described.

—Outermost Layer 121—

For example, the outermost layer 121 is a resin layer which contains a resin material and a conductive agent and has a surface (the outermost surface of the intermediate transfer member) scattered with plural recessed portions 123 having a curved inner wall.

Specifically, the outermost layer 121 contains for example a resin material, plural particles 124 (hereinafter, referred to as "particles to be removed 124"), a conductive agent and optionally other additives.

In addition, for example, particles exposed to the surface of the outermost layer 121 (particles present on the surface layer) are removed (for example, separated, broken or distorted) and the recessed portions 123 having a curved inner wall are thus scattered on the surface.

The recessed portion 123 will be described.

The recessed portion 123 is for example indented from the flat surface of the outermost layer 121 and is a space surrounded by a curved wall surface (the surface composed of the outermost layer 121).

The average diameter of the recessed portion 123 is for example smaller than a particle diameter of the toner particles (for example, a volume average particle diameter (D50v) of from 2.0 μm to 10 μm) and is larger than a particle diameter of external additive particles (for example, a volume average particle diameter (D50v) of from 5 nm to 500 nm).

As a result, toner particles are not incorporated in the recessed portion 123, the area where the toner particles contacts the outermost layer 121 is readily reduced, the external additive particles are readily incorporated therein and adhesive force of the toner particles to the outermost layer 121 may be easily reduced. As a result, it is easy to improve transferability.

Specifically, the average diameter of the recessed portion 123 is for example from 0.005 μm to 5 μm (or from about 0.005 μm to about 5 μm), preferably from 0.01 μm to 2 μm, more preferably from 0.05 μm to 1 μm.

In addition, the average diameter of the recessed portion 123 is for example from $1/2{,}000$ to $1/2$, preferably from $1/1{,}000$ to $1/4$, more preferably from $1/500$ to $1/5$, of the particle diameter (volume average particle diameter) of toner particles.

On the other hand, the average diameter of the recessed portion 123 is for example from 1 time to 100 times and is preferably from 1.2 times to 50 times and more preferably from 1.5 times to 10 times of the particle diameter (volume average particle diameter) of the external additive particles.

In addition, the maximum depth of the recessed portions 123 is for example from 0.003 μm to 3 μm and is preferably from 0.03 μm to 2 μm and more preferably from 0.05 μm to 1 μm.

In addition, the maximum depth of the recessed portions 123 is for example from $1/4{,}000$ to $1/2$ and is preferably from $1/2{,}000$ to $1/4$ and more preferably from $1/1{,}000$ to $1/5$, of the particle diameter (volume average particle diameter) of toner particles.

In addition, the average diameter of the recessed portions 123 is for example from 0.1 time to 200 times and is preferably from 0.2 time to 100 times and more preferably from 0.4 time to 50 times of the particle diameter (volume average particle diameter) of the external additive particles.

In addition, the number of the recessed portions 123 (presence ratio in the outermost layer 121) is for example from 100 to 1,000,000 (or from about 100 to about 1,000,000) and is preferably from 500 to 800,000, and more preferably, from 1,000 to 500,000, in a unit area of 0.01 $mm^2$ on the surface of the outermost layer.

In addition, the recessed portion 123 may have any shape (seen in a vertical direction to the surface of the outermost layer 121) such as circular or amorphous shape.

Here, the average diameter and maximum depth of the recessed portion 123 are obtained by collecting samples from the formed outermost layer 121, observing the samples by scanning electron microscopy (SEM) or atomic force microscopy (AFM), measuring an average diameter and maximum depth of 10 randomly selected recessed portions 123 and averaging the measured values.

In addition, the number of recessed portions 123 is also obtained by observing samples collected in the same manner by scanning electron microscopy (SEM), measuring the number of recessed portions 123 in 10 randomly selected regions (0.01 $mm^2$) and averaging the values.

The resin material will be described.

The Young's modulus of the resin material is preferably 3,500 MPa or more, and more preferably 4,000 MPa or more, although it is varied depending on the belt thickness. When the Young's modulus is within this range, mechanical properties of the belt are satisfied. Examples of resin materials which satisfy the Young's modulus include, but are not limited to, polyimide resins, polyimide resins, polyamideimide resins, polyether ether ester resins, polyarylate resins, polyester resins and reinforcing material-containing polyester resins.

In addition, the Young's modulus is obtained by performing a tensile test in accordance with JIS K7127 (1999), drawing a tangent line in an initial deformation region of the obtained stress warped curve and obtaining the slope of the line. The measurement conditions are as follows: strip specimens (width 6 mm, length 130 nm); dumbbell No.; test speed of 500 mm/min; and thickness: thickness of belt body.

Of these resin materials, polyimide resins are preferable. The polyimide resin is a material having a high Young's modulus and thus little deformation is caused (by stress of a support roll, cleaning blade or the like) during operation, as compared to other resins and realizes an intermediate transfer member (belt) which is relatively free of image defects such as out of color registration.

Examples of the polyimide resin include imide compounds of polyamidic acid, polymers of tetracarboxylic acid dianhydrides and diamine compounds. Specifically, the polyimide resin is for example obtained by polymerizing a tetracarboxylic acid dianhydride and a diamine compound in equivalent amounts in a solvent to obtain a polyamidic acid solution and imidizing the polyamidic acid.

For example, tetracarboxylic acid dianhydride is represented by formula (I) below.

(I)

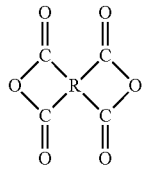

In formula (I), R represents a tetravalent organic group, an aromatic group, an aliphatic group, a cyclic aliphatic group, a combination of an aromatic group and an aliphatic group, or a substituent group thereof.

Specifically, examples of tetracarboxylic acid dianhydride include pyromellitic acid dianhydride, 3,3',4,4'-benzophenone tetracarboxylic acid dianhydride, 3,3',4,4'-biphenyl tetracarboxylic acid dianhydride, 2,3,3',4-biphenyltetracarboxylic acid dianhydride, 2,3,6,7-naphthalene tetracarboxylic acid dianhydride, 1,2,5,6-naphthalene tetracarboxylic acid dianhydride, 1,4,5,8-naphthalene tetracarboxylic acid dianhydride, 2,2'-bis(3,4-dicarboxyphenyl) sulfonic acid dianhydride, perylene-3,4,9,10-tetracarboxylic acid dianhydride, bis(3,4-dicarboxyphenyl)ether dianhydride and ethylene tetracarboxylic acid dianhydride.

Meanwhile, specific examples of diamine compounds include 4,4'-diaminodiphenylether, 4,4'-diaminodiphenylmethane, 3,3'-diaminodiphenylmethane, 3,3'-dichlorobenzidine, 4,4'-diaminodiphenylsulfide, 3,3'-diaminodiphenylsulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-amino-tertbutyl)toluene, bis(p-β-amino-tertbutyl phenyl)ether, bis(p-β-methyl-δ-amino phenyl) benzene, bis-p-(1,1-dimethyl-5-aminobenzyl) benzene, 1-iso propyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylene diamine, diaminopropyltetramethylene, 3-methylheptamethylenediamine, 4, 4-dimethylheptamethylenediamine, 2,11-diaminododecane, 1, 2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diamino eicosadecane, 1,4-diaminocyclohexane, 1,10-diamino-1,10-dimethyldecane, 12-diaminooctadecane, 2,2-bis[4-(4-aminophenoxy) phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

The solvent used for polymerization of tetracarboxylic acid dianhydride and diamine is preferably a polar solvent (organic polar solvent) in view of solubility. Examples of the polar solvent include N,N-dialkylamides and specific examples thereof include N,N-dialkylamides having a low molecular weight such as N,N-dimethylformamide, N,N-dimethylacetamide, N,N-diethylformamide, N,N-diethylacetamide, N,N-dimethylmethoxyacetamide, dimethylsulfoxide, hexamethylphosphotriamide, N-methyl-2-pyrrolidone, pyridine, tetramethylene sulfone and dimethyltetramethylene sulfone. These compounds may be used alone or in combination thereof.

The content of polyimide resin is for example from 10% by mass to 80% by mass, preferably from 20% by mass to 75% by mass, and more preferably from 40% by mass to 70% by mass, based on the total amount of components constituting the layer.

The polyimide resin may be used alone or in combination of two or more thereof.

The particles to be removed 124 will be described.

Examples of the particles to be removed 124 include fluorine resin particles, silica particles, melamine resin particles, metal (such as silver, copper, nickel) particles, metal chloride (such as silver chloride, nickel chloride) particles, metal oxide (such as zinc oxide, iron oxide) particles, barium sulfate particles and calcium carbonate particles. In addition, the particle may be a powder-form (particulate) conductive agent mentioned below.

Of the particles to be removed 124, fluorine resin particles which are readily removed from the superficial layer of the outermost layer 121 are preferable.

Examples of fluorine resin particles include ethylene tetrafluoride resin particles, ethylene trifluoride chloride resin particles, propylene hexafluoride resin particles, vinyl fluoride resin particles, vinylidene fluoride resin particles, ethylene difluoride dichloride resin particles and copolymer particles thereof.

Of these, for fluorine resin particles, polytetrafluoroethylene (ethylene tetrafluoride resin "PTFE"), tetrafluoroethylene-hexafluoro propylene-perfluoroalkyl vinyl ether copolymers ("FEP"), copolymers of tetrafluoroethylene and perfluoroalkyl vinyl ether ("PFA") are particularly preferable. More particularly, polytetrafluoroethylene (ethylene tetrafluoride resin "PTFE") is preferable.

When fluorine resin particles (in particular, ductile polytetrafluoroethylene) are removed from the superficial layer of the outermost layer 121 in which they are contained, they are distorted, and easily and suitably form a film of fluorine compound 125 (hereinafter, referred to as a fluorine compound film 125) on the inner wall of the recessed portion 123 and a part of the surface near the recessed portion 123 (see FIG. 3).

That is, in a case where a dispersant to disperse a fluorine resin constituting fluorine resin particles is mixed with a coating solution for forming the outermost layer 121, the fluorine compound film 125 is preferably a film containing the dispersant (fluorine-based graft polymer).

When the fluorine compound film 125 is present on the inner wall of the recessed portion 123 of the outermost layer 121 and a part of the surface near the recessed portion 123, the fluorine compound film 125 reduces adhesion of toner particles to the outermost layer 121 and external additive particles are readily adhered thereto due to presence of the fluorine compound film 125, and the external additive particles cause reduction in adhesion of toner particles to the outermost layer 121. As a result, improvement of transferability is realized and facilitated.

Figure 3A:
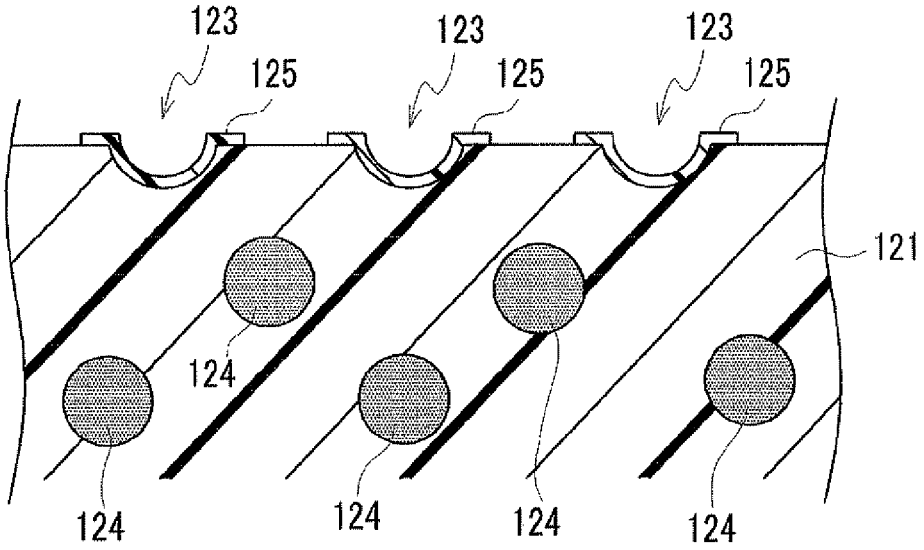
FIGS. 3A and 3B are schematic views illustrating a state in which a fluorine compound film is provided in an outermost layer of the intermediate transfer member according to the exemplary embodiment.
Figure 3B:
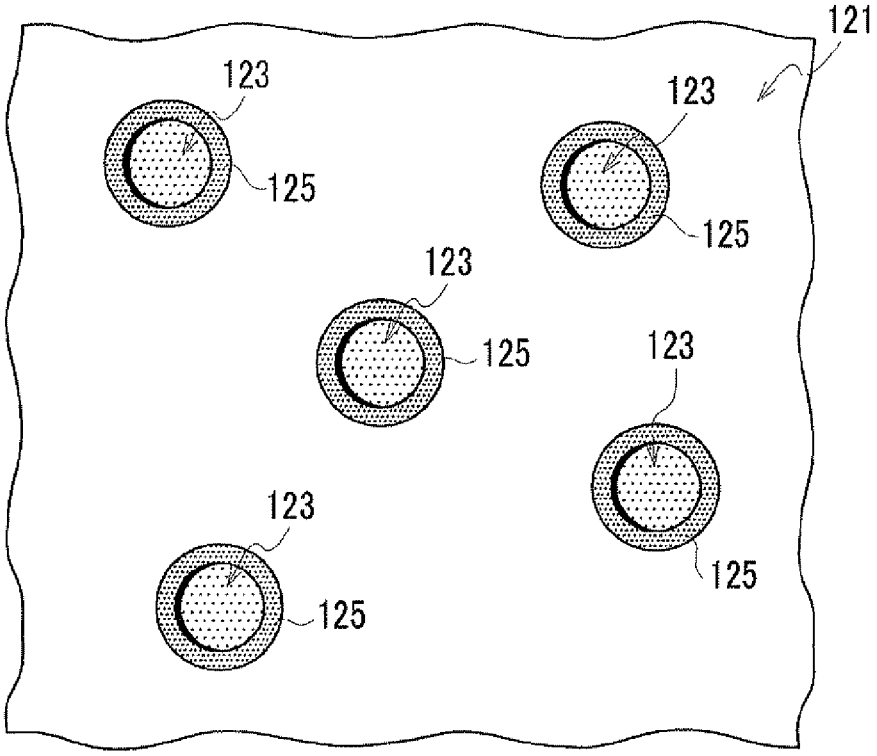

In addition, FIG. 3A is a sectional view taken along the line A-A of FIG. 1 and FIG. 3B is a plan view of FIG. 1.

The particles to be removed 124 are present as primary particles, secondary particles having a secondary particle diameter of 2 μm or less (preferably 1 μm or less, and more preferably 0.5 μm or less) or a combination thereof.

This means that the particles to be removed 124 are dispersed or contained in the form of primary particles, secondary particles (an agglomerate of at least two primary particles), or a combination thereof wherein at least agglomerated particles have a secondary particle diameter within the range defined above, that is, the particles to be removed 124 are dispersed with suppressed agglomeration.

In addition, the primary particles (non-agglomerated particles) of particles to be removed 124 have a particle diameter (primary particle diameter) of from 0.1 μm to 0.3 μm (from about 0.1 μm to about 0.3 μm).

The primary and secondary particle diameters of the particles to be removed 124 are obtained by collecting samples from the outermost layer of the photoreceptor, observing the samples with a scanning electron microscope (SEM) at a magnification of 5,000× or more, measuring maximum diameters of the primary particles and agglomerated fluorine resin particles and averaging maximum diameters of 50 particles. In addition, secondary electric images are obtained at an accelerating voltage of 5 kV using JSM-6700 F (manufactured by Nippon Electric Co., Ltd.) as a SEM.

The content of the particles to be removed 124 is for example from 1% by mass to 50% by mass, preferably from 2% by mass to 45% by mass, and more preferably from 3% by mass to 40% by mass, based on the total amount of components constituting the layer.

The particles to be removed 124 may be used alone or in combination of two or more thereof.

Here, the particles to be removed 124 may be used in combination with a dispersant or the like so that the particles to be removed 124 are dispersed (contained) as described above.

For example, in a case where fluorine resin particles are used as the particles to be removed 124, the fluorine resin particles are preferably used in combination with a fluorine-based graft polymer as the dispersant.

Examples of the fluorine-based graft polymer include copolymers of macromonomers having polymeric functional groups on one end of molecular chains and polymeric fluorine-based monomers having an alkyl fluoride group.

Specifically, examples of the fluorine-based graft polymers include graft copolymers of polymers of acrylic acid ester, methacrylic acid ester, styrene compounds, or copolymers thereof, as macromonomers and perfluoroalkyl ethyl methacrylate and perfluoroalkyl methacrylate as fluorine-based monomers.

The preferable polymerization ratio of macromonomers and polymeric fluorine-based monomers is for example as follows: the content of fluorine in the fluorine-based graft polymer is from 10% by mass to 50% by mass (preferably from 10% by mass to 40% by mass, and more preferably from 10% by mass to 30% by mass).

The molecular weight (number average molecular weight) of the fluorine-based graft polymer is for example from 5,000 to 20,000, preferably from 5,000 to 17,500, and more preferably from 5,000 to 12,000.

The amount of the fluorine-based graft polymer is for example from 0.1% by mass to 10% by mass, based on the amount of fluorine resin particles.

Next, the conductive agent will be described.

Examples of conductive agent include conductive (for example, volume resistivity lower than $10^7$ Ω·cm, this is also applied in the following) or semi-conductive (for example, volume resistivity of from $10^7$ Ω·cm to $10^{13}$ Ω·cm, this is also applied in the following) powders (powders composed of particles having a primary particle diameter of lower than 10 μm, preferably powders composed of particles having a primary particle diameter of lower than 1 μm).

The conductive agent is not particularly limited and examples thereof include carbon black (for example, Ketjen black, acetylene black, or carbon black having an oxidized surface), metals (such as aluminum or nickel), metal oxide (such as yttrium oxide or tin oxide) compounds, ionic conductive materials (such as potassium titanate, LiCl) and conductive polymers (such as polyaniline, polypyrrole, polysulfone, polyacetylene).

The conductive agent is selected depending on the purpose of use and is preferably oxidized carbon black (for example, carbon black whose surface is provided with a carboxyl, quinone, lactone or hydroxyl group) having pH 5 or less (preferably pH 4.5 or less, and more preferably pH 4.0 or less), from viewpoints of stability of electric resistance over time, or electric field dependency to suppress concentration of electric field by transfer voltage and is preferably a conductive polymer (such as polyaniline) from the viewpoint of electrical durability.

The content of conductive agent is for example from 1% by mass to 50% by mass, preferably from 2% by mass to 40% by mass, and more preferably from 4% by mass to 30% by mass, based on the total amount of components constituting the layer.

The conductive agent may be used alone or in combination of two or more thereof.

—Base layer 122—

The base layer 122 contains a resin material and a conductive agent and optionally contains other additives.

The resin material will be described.

The Young's modulus of the resin material may be varied depending on the belt thickness and is preferably 3,500 MPa or more, and more preferably 4,000 MPa or more. Within this range, mechanical properties of the belt are satisfied. Any resin may be used without limitation so long as it satisfies the Young's modulus defined above and examples thereof include polyimide resins, polyimide resins, polyamideimide resins, polyether ether ester resins, polyarylate resins, polyester resins and reinforcing material-containing polyester resins.

In addition, the Young's modulus is obtained by performing a tensile test in accordance with JIS K7127 (1999), drawing a tangent line in an initial deformation region of the obtained stress warped curve and obtaining the slope of the line. The measurement conditions are as follows: strip specimens (width 6 mm, length 130 mm); dumbbell No. 1; test speed of 500 mm/min; and thickness: thickness of belt body.

Of these resin materials, polyimide resins are preferable. The polyimide resin is a material having a high Young's modulus and little deformation is thus caused during operation by belt rotation, as compared to other resins. In addition, in a case where the outermost layer 121 contains a polyimide resin, and the base layer 122 corresponding to a lower layer which contacts the outermost layer 121 also contains the polyimide resin, adhesion between the outermost layer 121 and the base layer 122 arranged thereunder is improved and detachment between the layers is suppressed.

In addition, examples of the polyimide resin are the same as examples of polyimide resins for the resin material constituting the outermost layer 121.

The conductive agent will be described.

Examples of the conductive agent are the same as those of conductive agent constituting the outermost layer 121.

Next, properties of the intermediate transfer member 101 according to the exemplary embodiment will be described.

The outer peripheral surface of the intermediate transfer member 101 according to the exemplary embodiment has a surface resistivity of from 9 (Log Ω/□) to 13 (Log Ω/□), and more preferably of from 10 (Log Ω/□) to 12 (Log Ω/□), in terms of a common logarithm. When the surface resistivity after a voltage is applied for 30 msec is higher than 13 (Log Ω/□) in terms of a common logarithm, the intermediate transfer member 101 is electrostatically adsorbed on the recording medium during secondary transfer and detachment of the recording medium may be thus impossible. Meanwhile, when the surface resistivity after a voltage is applied for 30 msec is lower than 9 (Log Ω/□) in terms of a common logarithm, the intermediate transfer member has an insufficient retention property of the toner image primarily transferred on the intermediate transfer member, thus causing graininess or image disarray as image quality.

In addition, surface resistivity in terms of a common logarithm is controlled by the type of conductive agent and amount of conductive agent added.

Figure 5A:
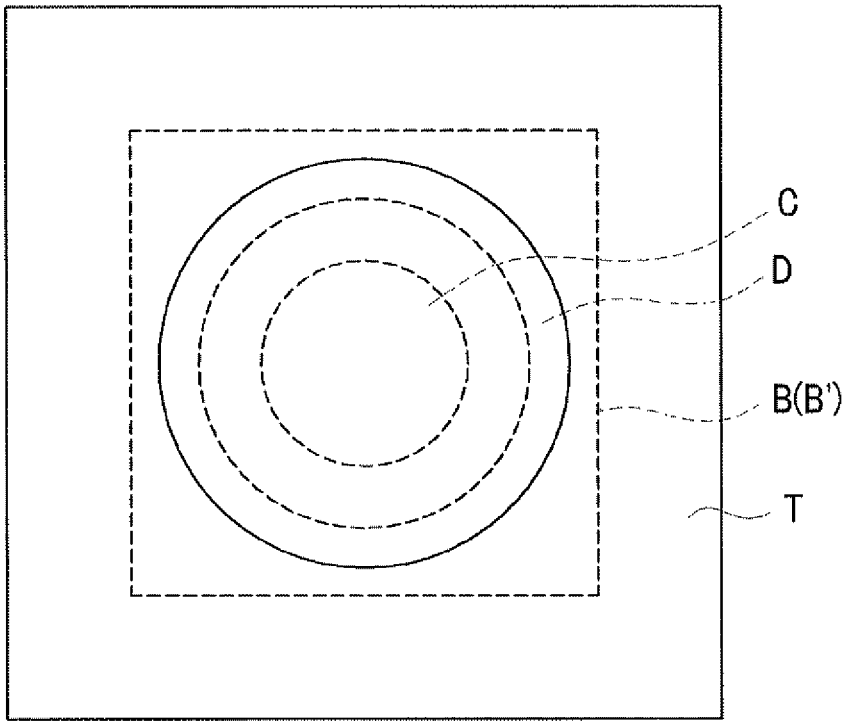
FIGS. 5A and 5B are a plan view and a sectional view schematically illustrating a circular electrode according to one example, respectively.
Figure 5B:
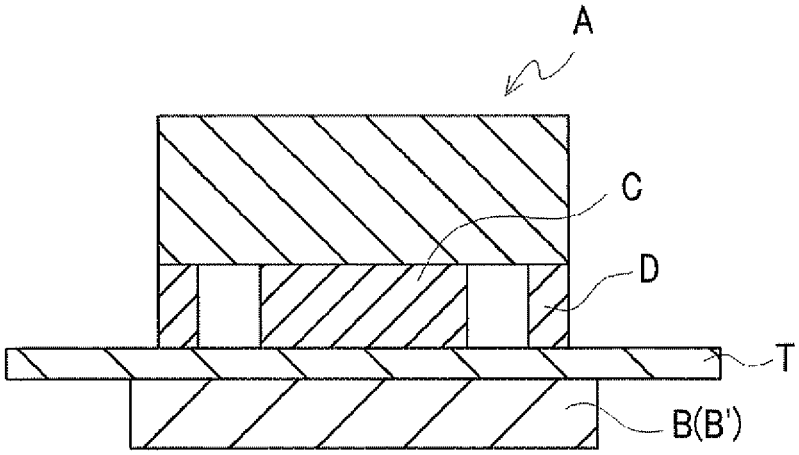

Here, the measurement of surface resistivity is performed as follows. The surface resistivity is measured using a circular electrode (for example, Hiresta. IP "UR probe", manufactured by Mitsubishi Petrochemical Co., Ltd.) in accordance with JIS K6911. The method for measuring surface resistivity will be described with reference to the drawing. FIGS. 5A and 5B are a schematic plan view and a schematic sectional view illustrating a circular electrode according to one exemplary embodiment, respectively. The circular electrode shown in FIG. 5 is provided with a first voltage-applying electrode A and a plate insulator B. The first voltage-applying electrode A includes a columnar electrode unit C and a cylindrical ring-shaped electrode unit D which has an inner diameter larger than the outer diameter of the columnar electrode unit C and surrounds the columnar electrode unit C such that it is spaced therefrom by a predetermined distance. A belt T is interposed between the columnar electrode unit C, the ring-shaped electrode unit D and the platy insulator B in the first voltage-applying electrode A. The surface resistivity ρs(Ω/□) of the transfer surface of the belt T is calculated according to the following equation by measuring a current I (A) which is applied between the columnar electrode unit C and the ring-shaped electrode unit D in the first voltage-applying electrode A, when a voltage V (V) is applied therebetween. Here, in the following equation, d (mm) represents an outer diameter of the columnar electrode unit C and D (mm) represents an inner diameter of the ring-shaped electrode unit D.

$$\rho s=\pi\times(D+d)/(D-d)\times(V/I) \qquad \text{Equation:}$$

In addition, the surface resistivity is calculated from a current obtained by applying a voltage of 500 V for 10 seconds at 22° C./55% RH using a circular electrode (Hiresta IP UR probe manufactured by Mitsubishi Petrochemical Co., Ltd.: outer diameter of columnar electrode unit C: Φ16 mm, and inner diameter and outer diameter of ring-shaped electrode unit: Φ30 mm and Φ40 mm, respectively).

The intermediate transfer member 10 according to the exemplary embodiment preferably has a volume resistivity in terms of a common logarithm of from 8 (Log Ωcm) to 13 (Log Ωcm) When the volume resistivity in terms of a common logarithm is lower than 8 (Log Ωcm), it is difficult to exert an electrostatic force to maintain electric charges of unfixed toner images which are transferred from the image holding member to the intermediate transfer member, the toner is scattered around the images by electrostatic repulsive forces between toner particles or a force of a fringe electric field on image edges, and images with serious noise may be formed. Meanwhile, when volume resistivity is higher than 13 (Log Ωcm) in terms of a common logarithm, a maintenance force of electric charges increases and the surface of the intermediate transfer member is changed in the transfer electric field during primary transfer, and erasing mechanism may be thus required.

In addition, volume resistivity in terms of a common logarithm is controlled depending on the type of conductive agent and the amount of conductive agent added.

Here, the measurement of volume resistivity is performed as follows. The volume resistivity is measured using a circular electrode (For example, Hiresta IP "UR probe", manufactured by Mitsubishi Petrochemical Co., Ltd.) in accordance with JIS K6911. The method for measuring volume resistivity will be described with reference to the drawing. The measurement is carried out using the same apparatus as the surface resistivity. The circular electrode shown in FIG. 5 is provided with a second voltage applying electrode B', instead of the plate insulator B during the measurement of the surface resistivity. In addition, a belt T is interposed between the columnar electrode unit C, the ring-shaped electrode unit D and the second voltage applying electrode B' in the first voltage-applying electrode A. The volume resistivity ρv (Ωcm) of the belt T is calculated according to the following equation by measuring a current I (A) which is applied between the columnar electrode unit C and the second voltage applying electrode 13' in the first voltage-applying electrode A, when a voltage V (V) is applied therebetween. Here, in the following equation, t represents a thickness of belt T.

$$\rho v=19.6\times(V/I)\times t \qquad \text{Equation:}$$

In addition, volume resistivity is calculated from a current obtained by applying a voltage of 500 V for 10 seconds at 22° C./55% RH using a circular electrode (Hiresta IP UR probe manufactured by Mitsubishi Petrochemical Co., Ltd.: outer diameter of columnar electrode unit C: Φ16 mm, and inner diameter and outer diameter of ring-shaped electrode unit: Φ30 mm and Φ40 mm, respectively).

In addition, 19.6 shown in the equation above is an electrode coefficient to convert columnar resistivity and is calculated from $\pi d^2/4t$ in which d (mm) represents an outer diameter of a columnar electrode unit and t (cm) represents a thickness of sample. In addition, the thickness of belt T is measured using an eddy current-type film thickness meter, CTR-1500 E manufactured by Sanko Electric Co., Ltd.

Hereinafter, the intermediate transfer member 101 according to the exemplary embodiment will be described.

In addition, a method for manufacturing an intermediate transfer member 101 wherein a polyimide resin is contained as a resin material in the base layer 122 and carbon black is contained as a conductive agent in the base layer 122 and the outermost layer 121 is described, but the intermediate transfer member 101 is not limited to this configuration.

First, a core is prepared. The prepared core may be a cylindrical die or the like. Examples of materials for the core include metals such as aluminum, stainless steel and nickel. The length of core should be equal to or higher than the length of the target intermediate transfer member 101 and is preferably larger than the length of the target intermediate transfer member 101 by 10% to 40%.

Then, a polyamidic acid solution in which carbon black is dispersed is prepared as a base layer-forming coating solution.

Specifically, for example, tetracarboxylic acid dianhydride and a diamine compound are dissolved in an organic polar solvent and carbon black is dispersed therein, followed by polymerization to prepare a polyamidic acid solution in which carbon black is dispersed.

At this time, the concentration of monomers in the polyamidic acid solution (concentration of tetracarboxylic acid dianhydride and the diamine compound in the solvent) is preferably from 5% by mass to 30% by mass, although it is determined depending on a variety of conditions. In addition, a polymerization temperature is preferably 80° C. or less, particularly preferably from 5° C. to 50° C. and a polymerization period is from 5 hours to 10 hours.

Then, a cylindrical die as a core is coated with a base layer-forming coating solution to form a film made of the base layer-forming coating solution.

The coating method of the cylindrical die with the coating solution is not particularly limited and examples thereof include a method in which the outer peripheral surface of the cylindrical die is dipped in the coating solution, a method in which the inner peripheral surface of the cylindrical die is coated with the coating solution, and a method in which the cylindrical die rotates in a horizontal axis and the coating solution is coated on outer peripheral or inner peripheral surfaces by "spin coating" or "die coating".

Next, the film made of the base layer-forming coating solution is dried to form a thin film for the base layer (dried film before imidization). The drying is for example performed preferably at a temperature of from 80° C. to 200° C. for 10 minutes to 60 minutes. When the temperature is high, heating time may be shortened. During heating, hot air may be applied. During heating, the temperature may be elevated stepwise or at a constant rate. The core rotates in a horizontal axis at a rate of from 5 rpm to 60 rpm. After drying, the core may be arranged in a vertical axis.

Next, a polyamidic acid solution in which the particles to be removed 124 (for example, fluorine resin particles) and carbon black are dispersed is prepared as an outermost layer-forming coating solution.

Specifically, tetracarboxylic acid dianhydride and a diamine compound are dissolved in the organic polar solvent, and carbon black is dispersed therein, followed by polymerization to prepare a polyamidic acid solution in which carbon black is dispersed.

Meanwhile, tetracarboxylic acid dianhydride and a diamine compound are dissolved in the organic polar solvent, and fluorine resin particles are dispersed together with dispersant (fluorine-based graft polymer), if necessary, followed by polymerization to prepare a polyamidic acid solution in which fluorine resin particles are dispersed.

In addition, the polyamidic acid solution in which carbon black is dispersed is mixed with the polyamidic acid solution in which fluorine resin particles are dispersed, to prepare a mixed solution as an outermost layer-forming coating solution.

In addition, the monomer concentration, polymerization temperature and polymerization time in the mixed solution are the same as those of the polyamidic acid solution as the base layer-forming coating solution.

Next, the formed thin film for base layer is coated with an outermost layer-forming coating solution to form a film made of the outermost layer-forming coating solution.

The method for coating the cylindrical die with the coating solution is not particularly limited and is the same as the method for coating the base layer-forming coating solution.

Next, the film made of the outermost layer-forming coating solution is dried to form a thin film for an outermost layer (dried film before imidization). The drying conditions are the same as those for the film made of the base layer-forming coating solution.

Next, the thin films for the base layer 122 and the outermost layer 121 are imidized (baked) to isolate the thin films from the core. As a result, an intermediate transfer member 101 as a layered structure including the base layer 122 and the outermost layer 121 is obtained.

For example, the imidization (baking) is performed by heating at 250° C. to 450° C. (preferably 300° C. to 350° C.) for 20 minutes to 60 minutes. As a result, an imidization reaction occurs and the thin film made of a polyimide resin is thus formed. Heating is performed while the temperature is slowly elevated stepwise or at a predetermined rate, before it reaches a final heating temperature.

In addition, it is preferable that thin films for the base layer and the outermost layer are simultaneously imidized (baked) from viewpoints of adhesion between the base layer 122 and the outermost layer 121. Alternatively, the film for base layer may be imidized (baked) to form a base layer and the outermost layer-forming coating solution may be coated thereon to form a base layer.

Figure 4A:
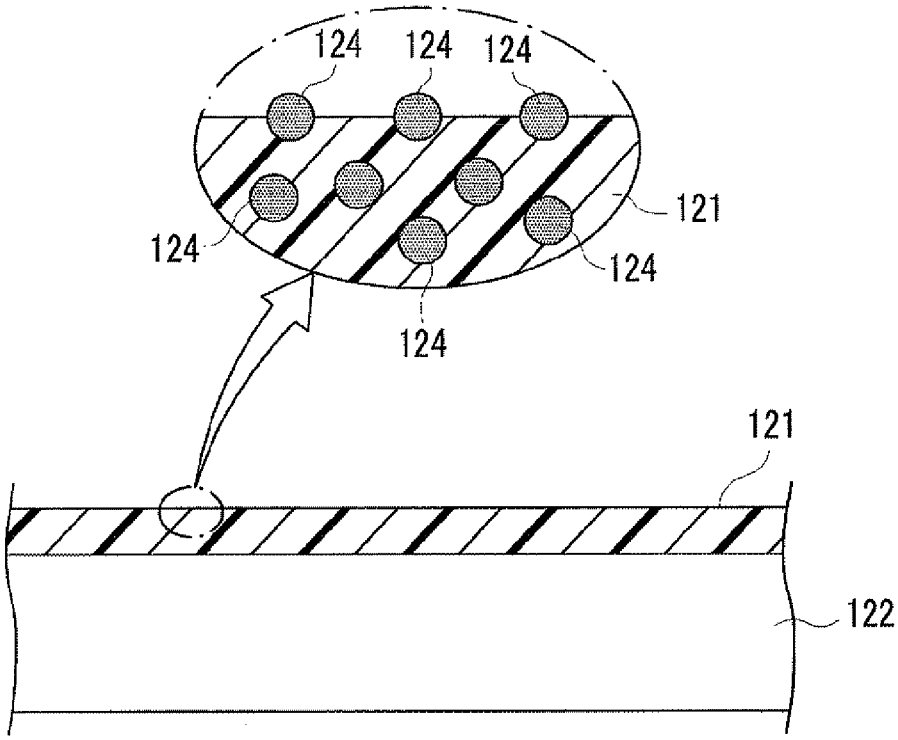
FIGS. 4A and 4B are schematic views illustrating a method for manufacturing the intermediate transfer member according to the exemplary embodiment.
Figure 4B:
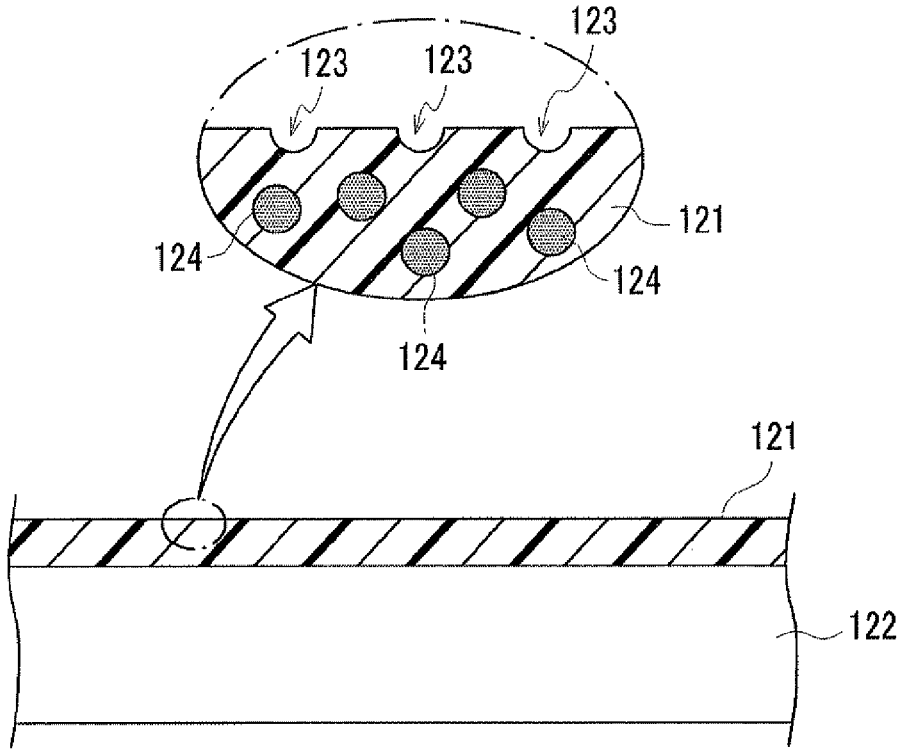

Here, after the base layer 122 and the outermost layer 121 are formed (see FIG. 4A), particles to be removed 124 (for example, fluorine resin particles) present on the superficial portion of the outermost layer 121 are removed (see FIG. 4B). That is, particles to be removed 124 exposed to the surface of the outermost layer 121, the resin layer, are removed.

Examples of removal methods include 1) removal of particles to be removed 124 by an adhesion force using an adhesive member (such as, adhesive tape), 2) removal of particles to be removed 124 by a frictional force using a friction member (such as a woven-fabric, non-woven fabric, rubber blade), 3) removal of particles to be removed 124 by wind power using a high-pressure gas, and 4) removal of particles to be removed 124 by a vibrational force using an ultrasonic generator.

Of these, removal of particles to be removed 124 by frictional force is preferable.

When the particles to be removed 124 are removed by this method, in the case where fluorine resin (in particular, ductile polytetrafluoroethylene) particles are applied as the particles to be removed 124, the particles are distorted when removed from the superficial portion of the outermost layer 121 in which they are contained, and easily and suitably form a fluorine compound film on the inner wall of the recessed portion 123 and a part of the surface near the recessed portion 123.

Although the intermediate transfer member 101 according to the exemplary embodiment having a two-layered structure including the base layer 122 and the outermost layer 121, wherein the outermost layer 121 is a resin layer in which plural recessed portions 123 having a curved inner wall are scattered on the surface thereof (the outermost surface of the intermediate transfer member) has been described above, the intermediate transfer member 101 may have a multilayered structure including two or more layers (such as a layered structure including an outermost layer 121, a base layer 122 and an intermediate layer therebetween, or a layered structure wherein the base layer 122 has two or more layers).

In addition, the intermediate transfer member 101 according to the exemplary embodiment may have a single layer structure of a resin layer in which plural recessed portions 123 having a curved inner wall are scattered on the surface thereof (the outermost surface of the intermediate transfer member).

In addition, the intermediate transfer member 101 according to the exemplary embodiment is not limited to a belt member and may be a roll member so long as it has, as the outermost layer 121, a resin layer in which plural recessed portions 123 having a curved inner wall are scattered on the surface thereof (the outermost surface of the intermediate transfer member).

(Intermediate Transfer Member Unit)

Figure 6:
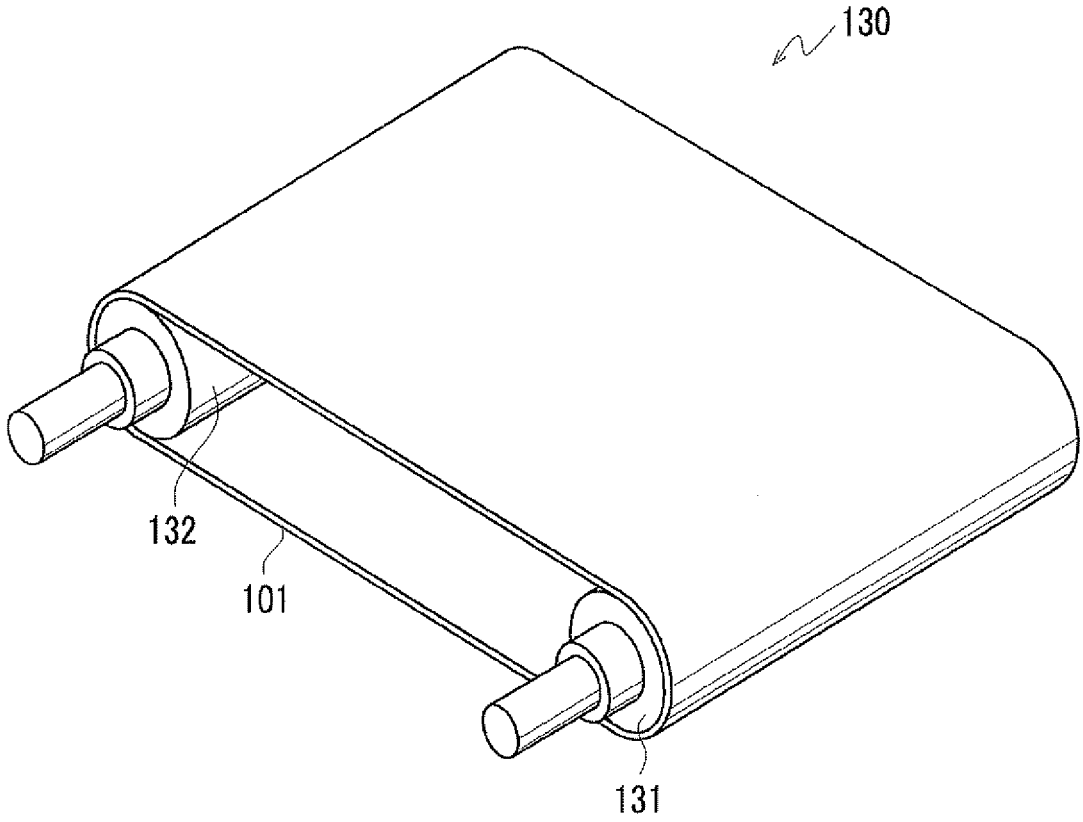
FIG. 6 is a schematic perspective view illustrating the intermediate transfer member unit according to the exemplary embodiment.

FIG. 6 is a schematic perspective view illustrating the intermediate transfer member unit according to the exemplary embodiment.

The intermediate transfer member unit 130 according to the exemplary embodiment includes the intermediate transfer member (intermediate transfer belt) 101 according to the previously described exemplary embodiment, as a belt member, as shown in FIG. 6. For example, the intermediate transfer member (intermediate transfer belt) 101 is slung through a tension applied across a driving roll 131 and a driven roll 132 which face each other (hereinafter, also referred to as "supported by tension").

Here, the intermediate transfer member unit 130 according to the exemplary embodiment includes as rolls to support the intermediate transfer member (intermediate transfer belt) 101, a roll to primarily transfer toner images present on the surface of an image holding member (for example, photoreceptor) to the intermediate transfer member (intermediate transfer belt) 101 and a roll to further secondarily transfer toner images transferred to the intermediate transfer member (intermediate transfer belt) 101 to a recording medium.

In addition, the number of rolls to pull the intermediate transfer member (intermediate transfer belt) 101 is not limited and the rolls may be arranged depending on aspects. The intermediate transfer member unit 130 having this configuration is incorporated and used in a device. When the driving roll 131 and the driven roll 132 rotate, the intermediate transfer member (intermediate transfer belt) 101 are pulled by the rolls and also rotates.

(Image Forming Apparatus)

The image forming apparatus according to the exemplary embodiment includes an image holding member, a charging unit that charges the surface of the image holding member, a latent image-forming unit that forms a latent image on the surface of the image holding member, a developing unit that develops the latent image by a toner and thereby forms a toner image, a transfer unit that transfers the toner image on a recording medium, and a fixing unit that fixes the toner image on the recording medium, wherein the transfer unit includes the intermediate transfer member according to the previously described exemplary embodiment.

Specifically, the image forming apparatus according to the exemplary embodiment, for example, includes the transfer unit which includes the intermediate transfer member and a primary transfer unit that primarily transfers the toner images formed on the image holding member to the intermediate transfer member, and a secondary transfer unit that secondarily transfers the toner images transferred from the intermediate transfer member to the recording medium wherein the intermediate transfer member according to that previously described is included as the intermediate transfer member.

Examples of the image forming apparatus according to the exemplary embodiment include common mono-color image forming apparatuses in which an only a single color toner is provided in a developing apparatus, color image forming apparatuses in which the toner images retained on the image holding member are repeatedly primarily transferred to the intermediate transfer member, and tandem color image forming apparatuses in which plural image holding members including respective colors of developers are arranged in series on the intermediate transfer member.

Figure 7:
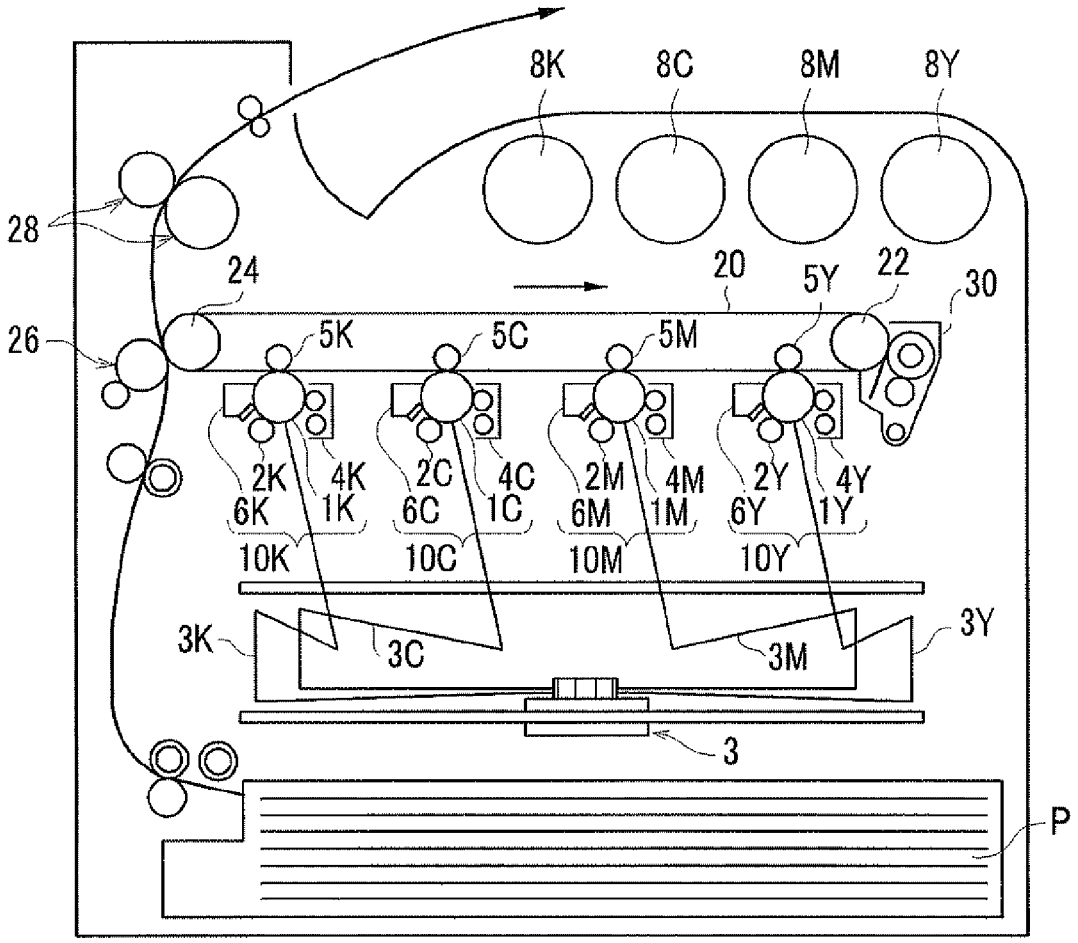
FIG. 7 is a schematic view illustrating the configuration of the image forming apparatus according to the exemplary embodiment.

Hereinafter, the image forming apparatus according to the exemplary embodiment will be described with reference to the drawings. FIG. 7 is a schematic view illustrating the configuration of the image forming apparatus according to the exemplary embodiment.

The image forming apparatus shown in FIG. 7 includes first to fourth electrophotographic image-forming units 10Y, 10M, 10C and 10K (image forming units) to output images of render respective colors of yellow (Y), magenta (M), cyan (C), and black (K), based on color-separated image data. These image-forming units (hereinafter, simply referred to as "units") 10Y, 10M, 10C and 10K are spaced from one another by a predetermined distance in a horizontal direction. In addition, these units 10Y, 10M, 10C and 10K may be a process cartridge detachable from the image forming apparatus.

In the drawing showing the units 10Y, 10M, 10C and 10K, in an upper region, the intermediate transfer belt 20 as the intermediate transfer member extends through respective units. The intermediate transfer belt 20 is wound and stretched on a driving roll 22 and a support roll 24 contacting the inner surface of the intermediate transfer belt 20 which are spaced from each other at left and right sides and a transfer unit for the image forming apparatus is designed such that it moves from the first unit 10Y to the fourth unit 10K.

In addition, the support roll 24 is pushed farther apart from the driving roll 22 by a tool such as spring (not shown) to apply a predetermined tension to the intermediate transfer belt 20 wound over both rolls. In addition, the image holding member of the intermediate transfer belt 20 is provided at the side thereof with an intermediate transfer member cleaning unit 30 which faces the driving roll 22.

In addition, the developing devices (developing units) 4Y, 4M, 4C and 4K of the units 10Y, 10M, 100 and 10K supply toners of four colors of yellow, magenta, cyan, black accepted in toner cartridges 8Y, 8M, 8C and 8K, respectively.

The first to fourth units 10Y, 10M, 100 and 10K described above have an identical configuration. For this reason, in this embodiment, the first unit 10Y to form a yellow image embedded in an upper region in a movement direction of the intermediate transfer belt will be representatively described. In addition, reference numerals to indicate magenta (M), cyan (C) and black (K), instead of the yellow (Y) may be numbered in the same position as the first unit 10Y and second to fourth units 10M, 100 and 10K will be not described.

The first unit 10Y includes a photoreceptor 1Y functioning as an image holding member. Near the photoreceptor 1Y, a charging roll 2Y to charge the surface of the photoreceptor 1Y at a predetermined voltage, an exposure unit 3 to expose the charged surface by a laser light 3Y based on the color separated image signals and thereby form an electrostatically charged image, a developing device (developing unit) 4Y to supply a charged toner to the electrostatically charged image and thereby develop an electrostatically charged image, a primary transfer roll 5Y (primary transfer unit) to transfer the developed toner image to the intermediate transfer belt 20, and a photoreceptor cleaning unit (cleaning tool) 6Y to remove the toner left on the surface of the photoreceptor 1Y after the primary transfer in a cleaning blade are embedded in this order.

In addition, the primary transfer roll 5Y is arranged at an inner side of the intermediate transfer belt 20 and faces the photoreceptor 1Y. In addition, bias powers (not shown) to apply a primary transfer bias are connected to the respective primary transfer rolls 5Y, 5M, 5C and 5K. Respective bias powers change transfer bias applied to the primary transfer rolls with a control unit (not shown).

Hereinafter, operation of the first unit 10Y which forms a yellow image will be described. First, prior to the operation, the surface of the photoreceptor 1Y is charged with a potential of from about −600 V to about −800 V by the charging roll 2Y.

The photoreceptor 1Y is formed by laminating a photosensitive layer on a conductive (at 20° C., volume resistivity: $1\times10^6$ Ωcm or less) substrate. This photosensitive layer generally has a high resistance (about resistance of general resins) and when the laser light 3Y is irradiated, it undergoes variation in specific resistance in regions in which the laser light is irradiated. Accordingly, the laser light 3Y is output through the exposure unit 3 on the charged surface of the photoreceptor 1Y, based on image data for yellow supplied from the control unit (not shown). The laser light 3Y is irradiated to the photosensitive layer of the surface of the photoreceptor 1Y and a yellow printing pattern of electrostatically charged image is thus formed on the surface of the photoreceptor 1Y.

The term "electrostatically charged image" is an image formed on the surface of the photoreceptor 1Y by electric charging. Specific resistance of regions of the photosensitive layer where laser light 3Y is irradiated decreases and electric charges electrified on the surface of the photoreceptor 1Y flow, while electric changes remain in regions where laser light 3Y is not irradiated. These remaining charges cause formation of the electrostatically charged image, so-called "negative latent image".

The electrostatically charged image thus formed on the photoreceptor 1Y rotates to a predetermined development position according to movement of the photoreceptor 1Y. In addition, in this development position, the electrostatically charged image present on the photoreceptor 1Y is visualized (developed image) by the developing device 4Y.

The developing device 4Y for example contains a yellow toner. The yellow toner is stirred in a developing device 4Y and thus frictionally electrified, has electric charges with the same polarity (negativity) as electric charges electrified on the photoreceptor 1Y and is supported on a developer roll (developer holding member). When the surface of the photoreceptor 1Y passes through the developing device 4Y, yellow toner is electrostatically adhered to latent image parts erased on the surface of the photoreceptor 1Y and a latent image is developed by the yellow toner. The photoreceptor 1Y on which the yellow toner image is formed continues moving at a predetermined rate to transfer the toner image developed on the photoreceptor 1Y to a predetermined primary transfer position.

When the yellow toner image developed on the photoreceptor 1Y is transferred to a predetermined primary transfer position, a specific primary transfer bias is applied to the primary transfer roll 5Y, electrostatic force directed from the photoreceptor 1Y toward the primary transfer roll 5Y is applied to the toner image, and toner image on the photoreceptor 1Y is transferred to the intermediate transfer belt 20. At this time, the applied transfer bias is positive (+), opposite to polarity (−) of toner and is for example controlled to about +10 μA by a control unit (not shown) in the first unit 10Y.

Meanwhile, the toner left on the photoreceptor 1Y is removed and recovered by a cleaning unit 6Y.

In addition, the primary transfer biases applied to primary transfer rolls 5M, 5C and 5K at the second unit 10M and therebeyond are also controlled in accordance with the first unit.

As a result, intermediate transfer belt 20 on which the yellow toner image is fed from the first unit 10Y is transferred to the second to fourth units 10M, 10C and 10K in this order, toner images of respective colors are multi-transferred thereon.

The intermediate transfer belt 20 on which toner images of four colors through the first to fourth units are multi-transferred transfers to a secondary transfer unit including the intermediate transfer belt 20, a support roll 24 which contacts the inner surface of the intermediate transfer belt 20 and a secondary transfer roll (secondary transfer unit) 26 arranged on the image support surface side of the intermediate transfer belt 20. Meanwhile, a recording medium P is supplied through a supply mechanism at a predetermined timing to a nip at which the secondary transfer roll 26 and the intermediate transfer belt 20 is urged against each other and the predetermined secondary transfer bias is applied to the support roll 24. At this time, the applied transfer bias is negative (−), the same as the polarity (−) of toner. An electrostatic force directed from the intermediate transfer belt 20 toward the recording medium P is applied to the toner image, and the toner image on the intermediate transfer belt 20 is transferred to the recording medium P. In addition, the secondary transfer bias is determined by a resistance detected using a resistance detector (not shown) to detect resistance of the secondary transfer unit and is voltage-controlled.

Then, the recording medium P is transferred to a fixing device (fixing unit) 28. When the toner image is heated, a multi-colored toner image is melted and fixed on the recording medium P. The recording medium P having a fixed color image is discharged to an outlet and a series of color image formation processes are completed.

EXAMPLES

Hereinafter, the present invention will be described with reference to the following examples but are not limited thereto.

Example 1

Preparation of Base Layer-Forming Coating Solution

First, 8% by mass (based on solid mass ratio) of carbon black (SPECIAL Black 4, manufactured by Evonik Degussa Japan Co., Ltd.) is added to a polyamidic acid N-methyl-2-pyrrolidone (NMP) solution (Uimide KX manufactured by UNITIKA MATE CO., LTD., solid concentration of 20% by mass) containing biphenyltetracarboxylic acid dianhydride (BPDA) and p-phenylene diamine (PDA). The solution is dispersed by a jet mill disperser (Geanus PY manufactured by Geanus Co., Ltd.) (200 N/mm$^2$, 5 pass). The carbon black-dispersed polyamidic acid solution thus obtained is passed through a 20 μm mesh made of a stainless steel to remove foreign materials and carbon black agglomerated materials. In addition, the reaction solution is defoamed under vacuum with stirring for 15 minutes to prepare a final solution. This solution is used as a base layer-forming coating solution.

(Preparation of Outermost Layer-Forming Coating Solution)

—Preparation of Carbon Black-Dispersed Polyamidic Acid Solution—

First, 15% by mass (based on solid mass ratio) of carbon black (SPECIAL Black 4, manufactured by Evonik Degussa Japan Co., Ltd.) is added to a polyamidic acid N-methyl-2-pyrrolidone (NMP) solution (Uimide KX manufactured by UNITIKA MATE CO., LTD., solid concentration of 20% by mass) containing biphenyltetracarboxylic acid dianhydride (RPDA) and p-phenylene diamine (PDA). The solution is dispersed by a jet mill disperser (Geanus PY manufactured by Geanus Co., Ltd.) (200 N/mm$^2$, 5 pass). The carbon black-dispersed polyamidic acid solution thus obtained is passed through a 20 μm mesh made of a stainless steel to remove foreign materials and carbon black agglomerated materials. In addition, the reaction solution is defoamed under vacuum with stirring for 15 minutes to prepare a final solution.

—Preparation of Fluorine Resin Particle-Dispersed Polyamidic Acid Solution—

First, a polyamidic acid N-methyl-2-pyrrolidone (NMP) solution (Uimide KX manufactured by UNITIKA MATE CO., LTD., solid concentration of 20% by mass) containing biphenyltetracarboxylic acid dianhydride (BPDA) and p-phenylene diamine (PDA) is prepared.

Next, 20% by mass (based on solid mass ratio) of PTFE particles having a primary particle diameter of 0.2 μm and 1% by mass (based on solid mass ratio) of a fluorine resin particles dispersant (S-386 manufactured by AGC Seimi Chemical CO., Ltd.) are mixed with this solution. The solution is dispersed by a jet mill disperser (Geanus PY manufactured by Geanus Co., Ltd.) (200 N/mm$^2$, 5 pass).

The fluorine resin particle-dispersed polyamidic acid solution thus obtained is passed through a 20 μm mesh made of a stainless steel to remove foreign materials and agglomerated PTFE materials. In addition, the reaction solution is defoamed under vacuum with stirring for 15 minutes to prepare a final solution.

—Preparation of Mixed Solution—

500 parts by mass of carbon black-dispersed polyamidic acid solution is mixed with 500 parts by mass of fluorine resin particle-dispersed polyamidic acid solution in a rotary mixer to prepare a mixed solution.

This solution is used as an outermost layer-forming coating solution.

(Production of Intermediate Transfer Belt)

A cylinder made of SUS304 having an outer diameter of 600 mm, a thickness of 8 mm and a length of 900 mm is prepared, as a support plate, a circular plate which has a thickness of 8 mm and an outer diameter corresponding to the diameter of the cylinder and is provided with four vents with a diameter of 150 mm made of the same SUS as above is produced, and the circular plate is fixed and welded on both ends of the cylinder to obtain a core. The outer peripheral surface of the core is roughened to Ra of 0.4 μm by blasting with alumina particles.

Next, the outer peripheral surface of the core is coated with a silicone-based release agent (trade name: SEPA-COAT, manufactured by Shin-Etsu Chemical Co., Ltd.) and baked at 300° C. for one hour.

Next, the base layer-forming coating solution is coated on the outer peripheral surface of the core to form a film made of the first thin film-forming resin solution.

At this time, coating of the base layer-forming coating solution is carried out by spin coating.

Coating is carried out as follows. The base layer-forming coating solution is discharged at a flow rate of 25 ml/min from a nozzle of a stream flow device in which a container containing 15 liters of the base layer-forming coating solution is connected to a monopump, the core is rotated at a rate of 20 rpm, the discharged base layer-forming coating solution is adhered onto the core, and a blade is pressed on the surface and moved at a rate of 210 mm/min in an axial direction of the core. The blade herein used is a stainless steel plate having a thickness of 0.2 mm, which is processed to a width of 20 mm and a length of 50 mm. In addition, the coating width is from the position 10 mm from one end to the position 10 mm from the other end in an axial direction of the core. After coating, the rotation is kept for 5 minutes to remove spiral streaks of the film surface.

As a result, a film made of the base layer-forming coating solution having a film thickness of 200 μm is formed. This thickness corresponds to a film thickness of 40 μm obtained after completion of production.

Then, the core is rotated at a rate of 10 rpm and at the same time, placed in a drying oven at 180° C. for 20 minutes to dry the film made of the base layer-forming coating solution. As a result, a thin film for the base layer is formed.

Next, the outermost layer-forming coating solution is coated on the outer peripheral surface of the thin film for the base layer to form a film made of the outermost layer-forming coating solution.

At this time, coating of the outermost layer-forming coating solution is carried out in the same manner as in the base layer-forming coating solution under the following coating condition: the amount of coating solution discharged from the nozzle is 25 ml/min. The coating width is also from the position 10 mm from one end to the position 10 mm from the other end in an axial direction of the core. After coating, the rotation is kept for 5 minutes to remove spiral streaks of the film surface.

As a result, a film made of the outermost layer-forming coating solution having a film thickness of 200 μm is formed. This thickness corresponds to a film thickness of 40 μm obtained after completion of production.

Then, the core is rotated at a rate of 10 rpm and at the same time, placed in a drying oven at 185° C. for 30 minutes to dry the film made of the base layer-forming coating solution. As a result, a thin film for the outermost layer is formed.

Next, the core is isolated from a rotating table and vertically placed in a heating furnace and heated at 200° C. for 30 minutes and at 300° C. for 30 minutes to dry the solvent left on thin films for the base layer and the outermost layer and imidize the films.

Then, the layered structure including the base layer and the outermost layer is isolated from the core to obtain an endless belt.

The center of this endless belt in a width direction is cut and an unwanted portion thereof is cut from both ends thereof, an average film thickness is measured with a dial gauge at 5 points of the obtained two endless belts with a width of 360 mm in an axial direction and 10 points thereof in a circumferential direction (50 points in total). The total thickness thus obtained is 80 μm.

Next, the surface of the outermost layer of the endless belt is frictionized with a woven fabric (trade name: BEMCOT AZ-8, manufactured by Asahi Kasei Spandex Co., Ltd.) to remove the fluorine resin particles exposed to the outermost layer. As a result, recessed portions having a curved inner wall are scattered on the surface of the outermost layer as traces left behind after the fluorine resin particles are removed.

In addition, as a result of observation of the surface of the outermost layer of the endless belt, fluorine resin particles are distorted and a fluorine compound film is thus formed on the inner wall of the recessed portion and the surface around the recessed portion.

The endless belt obtained in accordance with the process mentioned above is used as an intermediate transfer belt.

Example 2

An intermediate transfer belt is produced in the same manner as in Example 1, except that, instead of frictionizing with the woven fabric, the endless belt is soaked in water and subjected to ultrasonication to remove fluorine resin particles (PTFE particles) and dry water by warm air.

Example 3

An intermediate transfer belt is produced in the same manner as in Example 1, except that PFA particles with a primary particle diameter of 0.2 μm are used, instead of PTFE particles.

Example 4

An intermediate transfer belt is produced in the same manner as in Example 1, except that melamine resin particles with a primary particle diameter of 0.2 μm are used, instead of PTFE particles.

Example 5

An intermediate transfer belt is produced in the same manner as in Example 1, except that PTFE particles of 0.4 μm are used, instead of PTFE particles of 0.2 μm.

Example 6

An intermediate transfer belt is produced in the same manner as in Example 1, except that 40% by mass (based on solid mass ratio) of PTFE particles is mixed, instead of adding 20% by mass (based on solid mass ratio) of PTFE particles to prepare the fluorine resin particle-dispersed polyamidic acid solution.

Comparative Example 1

Example of Intermediate Transfer Belt Having Fluorine Resin Particle-Containing Outermost Layer An intermediate transfer belt is produced in the same manner as in Example 1, except that removal of fluorine resin particles exposed to the surface of the outermost layer of the obtained endless belt is not performed. The number of convex portions of the fluorine resin is 12,753.

Comparative Example 2

Example of Intermediate Transfer Belt Provided with Outermost Layer Having Roughened Surface An endless belt is obtained in the same manner as in Example 1, except that an outermost layer is formed using only carbon black-dispersed polyamidic acid solution as the outermost layer-forming coating solution.

Next, the surface of the outermost layer of the obtained endless belt is roughened by blast treatment using alumina particles (surface roughness Ra: 0.2 μm).

The surface-roughened endless belt is used as the intermediate transfer belt.

In addition, the surface roughness Ra is a value obtained by measuring a central line average roughness in accordance with JIS B0601 using a surface roughness meter (Surfcom 1400A (manufactured by Tokyo Seimitsu Co., Ltd.)) under the following conditions: measurement length: 5.000 mm; cut-off wavelength: 0.8 mm; and measurement rate: 0.30 mm/s, λs, in the presence of a filter, at 4 points in a circumferential direction (at angle of 90 degrees) and 3 points in an axial direction (50 mm from the upper end, the center and 50 mm from the lower end).

[Evaluation]

An image evaluation system modified from DocuColor 8000 Digital Press manufactured by Fuji Xerox Co., Ltd. (modified by separating a secondary transfer roll from power provided in the system and connecting the same to an external power source (MODEL 610D, manufactured by Japan Trek Co., Ltd.) so that a voltage could be directly applied to the secondary transfer roll from the outside) is prepared as an intermediate transfer-mode image forming apparatus, a developer 1 is filled in the developer and the intermediate transfer belt 1 is mounted thereon. The intermediate transfer-type image forming apparatus is provided with a cleaning blade arranged in a doctor method as a cleaning unit of the intermediate transfer belt.

Transferability and a cleaning property of the intermediate transfer belt are evaluated using the intermediate transfer-type image forming apparatus. In addition, the image quality obtained is evaluated. The results are shown in Table 1.

(Transferability of Intermediate Transfer Belt)

The transferability of the intermediate transfer belt is evaluated as follows. A transfer voltage to be applied from the external power source to a secondary transfer roll during printing is set as 3.0 kV. A cyan solid (concentration of 100%) image is output, a hard is stoped when the transfer process is completed, the weight of toner is transferred onto a tape in 2 points of the intermediate transfer member in the same manner as mentioned above, the toner-adhered tape is weighed, the value except for the weight of tape is averaged to obtain the amount of transfer toner (a). In the similar method as above, the amount of toner (b) left on the photoreceptor is obtained. Transfer efficiency is obtained in accordance with the following equation:

$$\text{transfer efficiency } \eta\ (\%) = a \times 100/(a+b) \qquad \text{Equation:}$$

Evaluation criteria are as follows.

A: transfer efficiency η of 99% or more

B: transfer efficiency η equal to or higher than 95% and lower than 99%

C: transfer efficiency η lower than 95%

(Cleaning Property of Intermediate Transfer Belt)

The cleaning property of intermediate transfer belt is evaluated as follows. A transfer voltage applied from the external power source to the secondary transfer roll during printing is set at 0 kV. A cyan solid (concentration of 100%) image is output, blade cleaning is performed such that the toner is not substantially transferred onto the intermediate transfer belt, the toner left on the intermediate transfer belt behind after the cleaning is transferred with a transparent cellophane tape and the tape is adhered to white paper. The residual toner is observed by the naked eye and is used as an evaluation grade.

The evaluation criteria are as follows:

A: No residual toner.

B: Slight residual toner (acceptable level)

C: Considerable residual toner (unacceptable level)

(Image Quality)

The image quality is evaluated as follows. A transfer voltage to be applied from the external power source to the secondary transfer roll during printing is set at 4.0 kV. Small white spots and transfer defects are evaluated for cyan solid (concentration of 100%) images, scale-shaped concentration unevenness is evaluated at cyan half tone (concentration of 70%), and HT unevenness is evaluated at cyan half tone (concentration 30%). The worst-grade image quality defect is used as an evaluation grade.

Evaluation criteria are as follows:

A: No image quality defect

B: Slight image quality defects (acceptable level)

C: Considerable image quality defects (unacceptable level)

In addition, the developer 1 used for each evaluation is prepared as follows.

(Preparation of Polyester Resin (A1) and Polyester Resin Particle Dispersion (a1))

15 parts by mole of polyoxyethylene (2,0)-2,2-bis(4-hydroxyphenyl) propane, 85 parts by mole of polyoxypropylene (2,2)-2,2-bis(4-hydroxyphenyl) propane, 10 parts by mole of terephthalic acid, 67 parts by mole of fumaric acid, 3 parts by mole of n-dodecenyl succinic acid, 20 parts by mole of trimellitic acid, and 0.05 parts by mole of dibutyltin oxide with respect to these acidic ingredients (the total moles of terephthalic acid, n-dodecenyl succinic acid, trimellitic acid and fumaric acid) are added to a heated and dried two-necked flask, nitrogen gas is introduced into the flask, the reaction mixture is maintained under an inert atmosphere and allowed to warm, followed by co-condensation polymerization at 150° C. to 230° C. for 12 to 20 hours. Then, the reaction pressure is gradually reduced at 210° C. to 250° C. to synthesize a polyester resin (A1). The resin had a weight average molecular weight Mw of 65,000 and a glass transition temperature Tg of 65° C.

3,000 parts by mass of the polyester resin thus obtained, 10,000 parts by mass of ion exchange water, and 90 parts by mass of sodium dodecylbenzene sulfonic acid as a surfactant are added to an emulsification tank of a high-temperature high-pressure emulsification system (Cavitron CD1010, slit: 0.4 mm), the mixture is hot-melted at 130° C., dispersed at 110° C. at a flow of 3 L/m and at a rotation rate of 10,000 rpm for 30 minutes and passed through a cooling tank to collect an amorphous resin particle dispersion (high-temperature high-pressure emulsification system Cavitron CD1010 slit 0. 4 mm) and thus obtain a polyester resin particle dispersion (a1).

(Preparation of Polyester Resin (B1) and Polyester Resin Particle Dispersion (b1))

45 parts by mole of 1,9-nonanediol, 55 parts by mole of dodecane dicarboxylic acid and 0.05 part by mole of dibutyltin oxide as a catalyst are added to a heated and dried three-necked flask and the air in the flask is replaced with inert atmosphere using a nitrogen gas by pressure reduction, followed by mechanically stirring at 180° C. for 2 hours. Then, the reaction solution is slowly heated to 230° C. under reduced pressure, stirred for 5 hours and the obtained thick solution is air-cooled, and the reaction is stopped to synthesize a polyester resin (B1). This resin had a weight average molecular weight Mw of 25,000 and a melt temperature Tm of 73° C.

Then, a polyester resin dispersion (b1) is obtained using a high-temperature high-pressure emulsification system (Cavitron CD1010, slit: 0.4 mm) under the same conditions as in preparation of the polyester resin dispersion (A1).

(Preparation of Colorant Particle Dispersion)

1,000 parts by mass of a cyan pigment (manufactured by Dainichi Co., Ltd., Pigment Blue 15:3 (copper phthalocyanine)), 150 parts by mass of an anionic surfactant, Neogen SC (manufactured by Daiichi Industrial Pharmaceutical Co., Ltd.) and an anionic surfactant (sodium lauryl sulfate manufactured by Wako Pure Chemical Co., Ltd.), and 4,000 parts by mass of ion exchange water are mixed, dissolved and dispersed for one hour using a high-pressure impact disperser, altimizer (HJP30006 manufactured by Sugino Machine Co., Ltd.) to prepare a colorant particle dispersion in which colorant (cyan pigment) particles are dispersed. The colorant (cyan pigment) particles of colorant particle dispersion had a volume average particle diameter of 0.15 μm and a colorant particle concentration of 20%.

(Preparation of release agent particle dispersion)

Wax (WEP-2, manufactured by Nippon Oil Co., Ltd.): 100 parts by mass

Anionic surfactant Neogen SC (manufactured by Daiichi Industrial Pharmaceutical Co., Ltd.): 2 parts by mass Ion exchange water: 300 parts by mass Fatty-acid amide wax (Neutron D manufactured by Fine Chemical Japan Co., Ltd.: 100 parts by mass Anionic surfactant (NEWREX R manufactured by Nippon Oil Co., Ltd.): 2 parts by mass Ion exchange water: 300 parts by mass These ingredients are heated at 95° C., dispersed using a homogenizer (Ultraturrax T50, manufactured by IRA Co., Ltd.) and dispersed using a pressure discharge Gaulin homogenizer (manufactured by Gaulin CO., LTD.) to prepare a release agent particle dispersion (1) (concentration of release agent: 20% by mass) in which release agent particles having a volume average particle diameter of 200 nm are dispersed.

(Preparation of Toner Particle 1)

Polyester resin particle dispersion (a1): 340 parts by mass

Polyester resin particle dispersion (b1): 160 parts by mass

Colorant particle dispersion: 50 parts by mass

Release agent particle dispersion: 60 parts by mass

Aqueous surfactant solution: 10 parts by mass 0.3 M aqueous nitric acid solution: 50 parts by mass Ion exchange water: 500 parts by mass These ingredients are added to a circular flask made of stainless steel, dispersed using a homogenizer (Ultraturrax T50 manufactured by IKA Co., Ltd.), heated in an oil bath for heating to 42° C., left to stand for 30 minutes, further left to stand in an oil bath for heating at an elevated temperature of 58° C. for 30 minutes, 100 parts by mass of a polyester resin particle dispersion (a1) is further added thereto, when formation of agglomerated particles is observed and the reaction solution is further left to stand for 30 minutes.

Then, 3% of sodium nitrilotriacetate (Chelest 70, manufactured by Chubu Chelest Co., Ltd.) is added with respect to the total amount of the solution. Then, a 1N aqueous sodium hydroxide solution is gently added until the mixture reaches pH 7.2, heated with stirring to 85° C. and maintained for 3.0 hours. Then, the reaction product is filtered, washed with ion exchange water and dried with a vacuum drier to obtain toner particles 1.

At this time, the particle diameter of the toner particles 1 is measured with a Coulter multisizer. The volume average particle diameter D50 is 4.5 μm and the particle diameter distribution coefficient GSD is 1.22.

(Preparation of Toner 1)

3 parts by mass of silica particles ("Fumed silica RX50" manufactured by Nippon Aerosil Co., Ltd., volume average particle diameter of 40 nm) are added to 100 parts by mass of the toner particles 1 and blended with a 5 liter Henschel mixer at a rate of 30 m/s for 15 minutes, coarse particles are removed with a 45 μm mesh filter to prepare a toner 1.

(Preparation of Developer 1)

First, 100 parts of ferrite particles (manufactured by Powder Tech Co., Ltd., average particle diameter of 50 μm), 1.5 parts of a methyl methacrylate resin (manufactured by Mitsubishi Rayon Co., Ltd., ratio of component having a molecular weight of 95,000 to 10,000:5%) are added to a pressure-type kneader together with 500 parts of toluene, followed by mixing with stirring at room temperature for 15 minutes, and distilling away toluene, while heating with mixing under reduced pressure to 70° C. Then, the reaction solution is cooled, and screened with a 105 μm sieve to obtain a resin-coated ferrite carrier.

The resin-coated ferrite carrier is mixed with the toner 1 to prepare a developer 1 (two-component electrostatically charged image developer) in which the concentration of toner is 7% by weight.

TABLE 1

| | Configuration of outermost layer of intermediate transfer belt | | | | | | | | |
|---|---|---|---|---|---|---|---|---|---|
| | Recessed portion | | | | | Presence of fluorine compound film on and near inner wall of recessed portion | Evaluation | | |
| | Presence | Average diameter (μm) | Maximum depth (μm) | Number per 0.01 $mm^2$ | Type of particles to be removed | | Transferability | Cleaning property | Image quality |
| Ex. 1 | Present | 0.18 | 0.95 | 19852 | PTFE particles | Present | A | A | A |
| Ex. 2 | Present | 0.19 | 0.89 | 13581 | PTFE particles | Absent | B | B | B |
| Ex. 3 | Present | 0.16 | 1.05 | 12493 | PFA particles | Present | B | A | B |
| Ex. 4 | Present | 0.15 | 0.84 | 11357 | Melamine resin particles | Absent | B | A | B |
| Ex. 5 | Present | 0.33 | 1.95 | 14955 | PTFE particles | Present | A | A | A |
| Ex. 6 | Present | 0.18 | 1.06 | 24875 | PTFE particles | Present | A | A | A |
| Comp. Ex. 1 | Absent | — | — | — | Absent | Absent | A | C | C |
| Comp. Ex. 2 | Roughened | 1.62 | −1.08 | 17259 | Absent | Absent | C | C | C |

As apparent from the results, Examples of the present invention exhibited superior transferability, cleaning property and image quality, as compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An intermediate transfer member comprising:
a resin layer as an outermost layer,
wherein the outermost layer comprises:
a surface,
an interior, and
fluorine resin particles,
wherein the surface comprises a plurality of recessed portions comprising a curved inner wall and being scattered on the surface of the outermost layer, the recessed portions being formed by removing fluorine resin particles that are exposed to the outermost layer surface while leaving fluorine resin particles completely disposed under the surface in the interior and that do not contact the outermost layer surface.

2. The intermediate transfer member according to claim 1, wherein from 100 to 1,000,000 recessed portions are present in a unit area of 0.01 $mm^2$ on the surface of the resin layer.

3. The intermediate transfer member according to claim 1, wherein the resin layer contains a fluorine compound film arranged on the inner wall of the recessed portion and a part of the surface near the recessed portion.

4. The intermediate transfer member according to claim 1, wherein the intermediate transfer member has a base layer and an outermost layer, wherein the outermost layer contains fluorine resin particles.

5. The intermediate transfer member according to claim 4, wherein the fluorine resin particles have an average primary particle diameter of from 0.1 μm to 0.3 μm.

6. The intermediate transfer member according to claim 1, wherein the recessed portion has an average diameter of from 0.005 μm to 5 μm .

7. An intermediate transfer member unit detachable from an image forming apparatus comprising:
a belt member as the intermediate transfer member according to claim 1; and
a plurality of rolls over which the belt member is wound by an applied tension.

8. The intermediate transfer member unit according to claim 7, wherein the belt member has from 100 to 1,000,000 recessed portions in a unit area of 0.01 $mm^2$ on the surface of the resin layer.

9. An image forming apparatus comprising:
an image holding member;
a charging unit that charges the surface of the image holding member;
a latent image-forming unit that forms a latent image on the surface of the image holding member;
a developing unit that develops the latent image and thereby forms a toner image using a toner containing toner particles and external additive particles;
the intermediate transfer member according to claim 1 to which the toner image formed on the surface of the image holding member is transferred;
a primary transfer unit that primarily transfers the toner image formed on the surface of the image holding member to the surface of the intermediate transfer member;
a secondary transfer unit that secondarily transfers the toner image formed on the surface of the intermediate transfer member to a recording medium; and
a fixing unit that fixes the toner image transferred to the recording medium.

10. The image forming apparatus according to claim 9, wherein an average diameter of the recessed portions of the intermediate transfer member is smaller than the particle diameter of the toner particles and is larger than the particle diameter of the external additive particles.

11. The image forming apparatus according to claim 9, wherein the intermediate transfer member includes from 100 to 1,000,000 recessed portions in a unit area of 0.01 $mm^2$ on the surface of the resin layer.

12. A method for manufacturing the intermediate transfer member according to claim 1, comprising:
forming a resin layer containing particles as an outermost layer; and removing the particles exposed to the surface of the resin layer.

13. The method according to claim 12, wherein the particles are fluorine resin particles.

14. The method according to claim 13, wherein the fluorine resin particles are polytetrafluoroethylene particles.

15. The method according to claim 13, wherein the intermediate transfer member includes from 100 to 1,000,000 recessed portions in a unit area of 0.01 $mm^2$ on the surface of the resin layer.

16. The intermediate transfer member according to claim 1, wherein the recessed portion has an average diameter of from about 0.15 μm to about 0.33 μm, and wherein from about 100 to about 24875 recessed portions are present in a unit area of 0.01 $mm^2$ on the surface of the resin layer.

17. An intermediate transfer member comprising:

a resin layer as an outermost layer, wherein the outermost layer comprises a surface and fluorine resin particles, wherein the surface comprises a plurality of recessed portions comprising a curved inner wall and being scattered on the surface of the outermost layer, the recessed portions being formed by removing fluorine resin particles that are exposed to the outermost layer surface while leaving fluorine resin particles completely disposed under the surface and that do not contact the outermost layer surface.

18. An intermediate transfer member comprising:

a resin layer as an outermost layer, wherein the outermost layer comprises a surface, an interior, and fluorine resin particles, wherein the surface comprises a plurality of recessed portions comprising a curved inner wall and being scattered on the surface of the outermost layer, the recessed portions being formed by removing fluorine resin particles that are exposed to the outermost layer surface while leaving fluorine resin particles completely disposed under the surface in the interior and that do not contact the outermost layer surface, wherein the resin layer contains a fluorine compound film arranged on the inner wall of the recessed portion and a part of the surface near the recessed portion, and not all of the surface of the outermost layer is covered with the fluorine compound film.

* * * * *